United States Patent [19]

Saito et al.

[11] 4,294,657

[45] Oct. 13, 1981

[54] APPARATUS FOR MAKING FIBERBOARD

[75] Inventors: Tsutomu Saito, Tokyo; Masaaki Shida, Fuji, both of Japan

[73] Assignee: Kabushiki Kaisha Fuji Seisakusho, Fuji, Japan

[21] Appl. No.: 175,826

[22] Filed: Aug. 5, 1980

Related U.S. Application Data

[63] Continuation of Ser. No. 7,641, Jan. 29, 1979, abandoned.

[30] Foreign Application Priority Data

Nov. 15, 1976 [JP] Japan ..... 51-136268
Jan. 31, 1978 [JP] Japan ..... 53-8850

[51] Int. Cl.[3] ..... D21F 11/02

[52] U.S. Cl. ..... 162/303; 162/336; 162/337; 162/350; 162/364; 162/320

[58] Field of Search ..... 162/348, 350, 351, 212, 162/336, 337, 363, 366, 203, 303, 320

[56] References Cited

U.S. PATENT DOCUMENTS

| | | | |
|---|---|---|---|
| 1,544,042 | 6/1925 | Shaw | 162/203 |
| 3,149,027 | 9/1964 | Mil | 162/351 |
| 3,595,744 | 7/1971 | Skoldquist | 162/203 |
| 3,775,244 | 11/1973 | Itubschmann | 162/351 |
| 4,113,555 | 9/1978 | Nyren et al. | 162/311 |

FOREIGN PATENT DOCUMENTS

| | | |
|---|---|---|
| 154135 | 11/1953 | Australia . |
| 159383 | 10/1954 | Australia . |
| 402371 | 1/1967 | Australia . |
| 450923 | 7/1974 | Australia . |
| 2053780 | 2/1974 | Fed. Rep. of Germany . |
| 2364023 | 8/1974 | Fed. Rep. of Germany . |
| 695575 | 8/1953 | United Kingdom . |
| 881165 | 11/1961 | United Kingdom . |
| 1006567 | 10/1965 | United Kingdom . |
| 1090638 | 11/1967 | United Kingdom . |
| 1298744 | 12/1972 | United Kingdom . |
| 1353186 | 5/1974 | United Kingdom . |
| 1374629 | 11/1974 | United Kingdom . |
| 231447 | 9/1968 | U.S.S.R. . |

*Primary Examiner*—William F. Smith
*Attorney, Agent, or Firm*—Haseltine and Lake

[57] ABSTRACT

The apparatus for manufacturing the fiberboard is in the form of two vertically opposed endless conveyors upon each of which a fiber layer is formed. Each conveyor has a slanted running portion as a part thereof. A suction box is disposed along the inner surface of each of the slanted running portions so that a fiber layer producing section is formed in each slanted portion. A passage is formed between the conveyors to direct a slurry flow of fibers along each conveyor. The relative speeds of the slurry flow through the passage along the surface of the conveyors is adjusted to be different than the running speed of the conveyors; a supply duct for the slurry flow is disposed in the center of said passage and has an outlet near the upper ends of the fiber layer forming sections. The two layers simultaneously formed can be placed upon each other to form a single layer of fiberboard.

2 Claims, 10 Drawing Figures

APPARATUS FOR MAKING FIBERBOARD

This is a continuation of application Ser. No. 7,641, filed Jan. 29, 1979, abandoned.

BACKGROUND OF THE INVENTION

This invention relates to an apparatus for making a fiberboard which may be suitably employed, for instance, as a wallboard or for other uses in building or the like. In the apparatus, a belt type conveyor for forming a fiber layer serves to direct the raw materials. The belt of the conveyor is permeable to air and water, such as a wire net or a fibrous material such as felt, and is arranged to run endlessly. A slurry of raw material fibers comprising a suitable length of vegetable, mineral or synthetic fibers or fibers mixed with an adhesive agent such as cement or the like, and is made into a desired thickness layer on the fiber forming conveyor.

SUMMARY OF THE INVENTION

The main object of the invention is to overcome the defects of the prior art.

Another object of the present invention is to provide an apparatus for facilitating continuous making of a fiberboard which has the raw material fibers arranged in order in the longitudinal direction thereof and is resistant to a bending or breaking force, and has at least one beautiful surface wherein the fibers are arranged in order in the longitudinal direction.

Another object of this invention is to facilitate making of a fiberboard of large thickness and has the fibers orderly arranged in the longitudinal direction for increased strength and are beautiful at both surfaces thereof.

A further object of the present invention is to obtain a fiberboard of larger thickness by such a manner that an intermediate layer is interposed between the fiber layers for the purpose of increase in thickness.

a further object is to make a fiberboard which has a uniform thickness throughout the whole area thereof free from concavo-convex portions.

The principal features of the present invention are directed to an apparatus for manufacturing fiberboard, wherein: an endless belt type conveyor is provided to form a fiber layer, said conveyor is arranged to have a desired length thereof, slanted as a running portion; a suction box provided on an inner surface of the slanted running portion of said conveyor to form a fiber layer of product thereon, and a passage means for directing the slurry flow of raw material fibers, said passage being disposed along an outer surface of said conveyor of the fiber layer forming section, and is so arranged whereby the respective speeds of the slurry flow through the passage and along on the surface of said conveyor is differentiated from the running speed of said conveyor.

Other objects and advantages of the present invention will best be understood with respect to the accompanying drawings:

DESCRIPTION OF THE INVENTION

Figure 1:
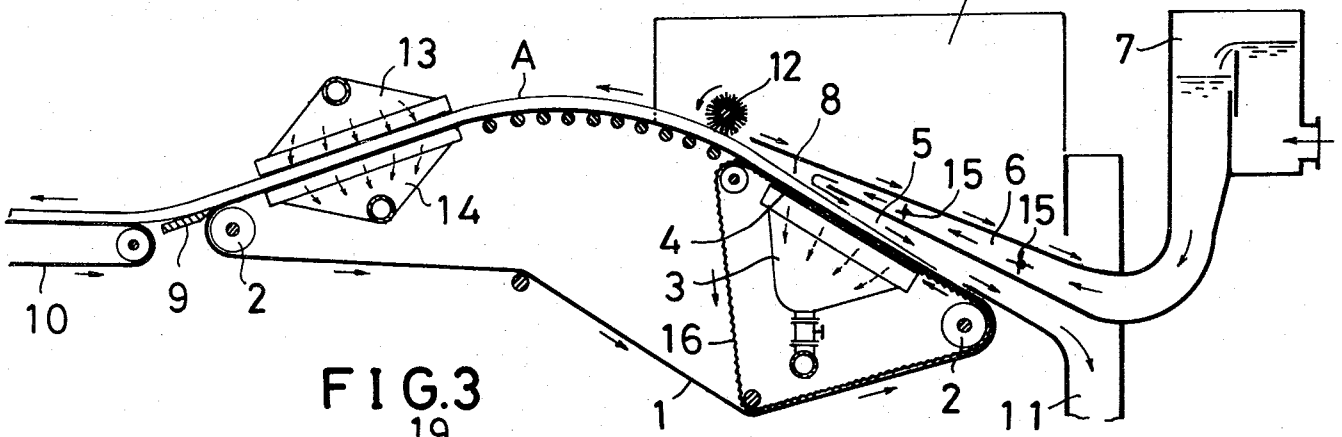
FIG. 1 is a sectional side view of one embodiment example of the invention.
Figure 3:
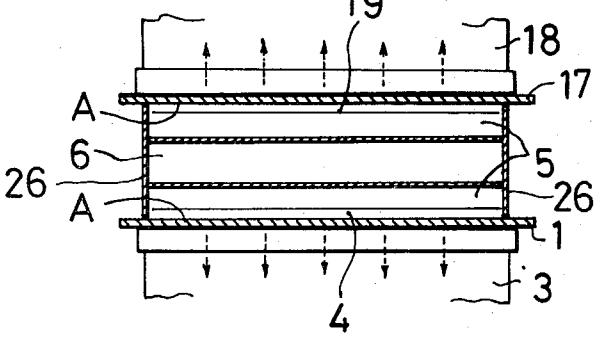
FIG. 3 is a cross sectional view of the same in FIG. 2.

FIG. 1 shows one example of the invention. A belt type fiber layer forming conveyor 1 is provided to endlessly bridge between and around guide rolls 2 and arranged to be driven to run in the direction shown by the arrows. A portion thereof is formed into a slanted running portion and a suction surface of a suction box 3 is put along the inner surface of the slanted running portion thereof, so that a slanted fiber layer forming section 4 is formed. A passage 5 for a slurry of raw material fibers is formed along the outer surface of the fiber layer conveyor 1 at a place where the slanted fiber layer making section 4 is located, and is defined by lateral walls 26 on both sides thereof. A front supply opening 8 of a supply duct 6 is connected to a raw material source tank 7 positioned at a level high enough to utilize a head and is positioned to be open at an upper portion of the inclination of the passage 5. Accordingly, the slurry of raw material fibers flowing out from the supply opening 8 flows down naturally along the inclination of the flow passage 5, and consequently the flow direction thereof is opposite to the running direction of the fiber layer conveyor 1. This means that the raw material fibers flow down at a speed different from the running speed of the fiber layer conveyor 1. In the course of this flow, the water content thereof is removed by the suction operation of suction box 3, and consequently the fibers are attracted onto the conveyor 1 and are developed into a layer of a predetermined thickness to form a sheet with a fiber layer.

This fiber layer sheet is conveyed in a forward direction by further running of the fiber layer conveyor 1, and is thereafter taken out from the fiber layer conveyor 1 at the other end thereof by the action of a stripping member 9. Subsequently the same is transferred onto and is discharged by a delivery belt 10 and thereafter, is subjected to any necessary subsequent steps such as cutting into a proper length, pressing with or without heating, drying, etc. and thus there can be produced a fiberboard.

The remainder of the raw material slurry fibers flowing down through the flow passage 5 is directed into a discharing tube 11 for recovery, and any excess of the slurry raw material fibers flowing in a forward direction from the supply opening 8 is turned back toward the discharge tube 11 by the action of a brush roll 12, and this recovered product is returned to the raw material source tank 7 for further use again.

Referring to the same Figure, an air blowing chamber 13 and an air suction chamber 14 are disposed to face each other on the opposite surface of the fiber layer, and these serve to expel and remove the water content from the layer by the action of blown air. A stirrer 15 such as a roll with fins or the like, is disposed in the supply tube 6, and the same serves to prevent the fibers in the slurry liquid from precipitating and the density distribution of the fibers from becoming non-uniform.

In the case where a sheet of fibrous material such as felt is used as the fiber layer conveyor 1, in order to avoid unnecessary wear by friction with the surface of the suction box 3 under the suction operation thereof, a belt 16 being of air-permeable material such as a wire net, that does not obstruct the suction operation is so interposed, as shown in the same Figure. The belt 16 is between the fiber layer conveyor 1 and the suction surface of the suction box 3 as to run endlessly along with the conveyor 1.

In the construction as described above, the fibers in raw material slurry flowing out of the supply opening 8 which is open at the upper portion of the inclined flow passage 5, are dispersed freely in the liquid at random but in the course of their downward flow naturally along the slope of the flowing passage 5, the fibers are naturally arranged in order along the flow direction. Additionally, when the flowing fibers are attracted at their respective ends by the suction operation of the suction box 3, to the surface of the fiber layer conveyor 1 or the surface of the fiber layer previously formed, these fibers are laid down along the surface of the fiber layer conveyor 1 due to the difference in speed between the fiber layer conveyor 1 and the fibers. Consequently, almost all of the fibers are orderly arranged in the running direction of the fiber layer conveyor 1 and the fiber layer is formed in this manner. As a result the fiberboard is extremely resistant to bending force and tensile force, in relation to the fiber direction and the contact surface with the fiber layer conveyor 1 is such that the fibers are arranged in order in the same direction and produce a very beautiful surface. Thus, there can be produced a fiberboard that is suitable for a wallboard for building or the like.

In addition, the fiber layer forming section 4 is so arranged so to have an inclination posture and have the flow passage 5 for the slurry raw material fibers provided along on the same. Therefore, simply by supplying the slurry raw material fibers from the upper side without using any power source, the slurry raw material fibers can flow down and the slurry raw material fibers can be supplied at a speed different from the running speed of the fiber layer conveyor 1, and thus there is brought about an advantage that the equipment of the apparatus can be simplified.

The slurry of raw material fibers may be any conventional one. For instance, the same comprises the fibers alone added in water or a mixture of fibers and at least any adhesive agent such as cement, powdered plastic, thermosetting synthetic resin, etc. added in water. The composition ratio of the slurry of raw material fibers, for instance, is wood pulp fibers of 2% in weight and water 98% in weight, or is 7~15% in weight of one or more kinds of fibers such as wood pulp, glass fibers, rock wool, synthetic fibers, etc. and 93~85% of water. If desired, any other inorganic or mineral powders may be added therewith as a filling agent.

Figure 2:
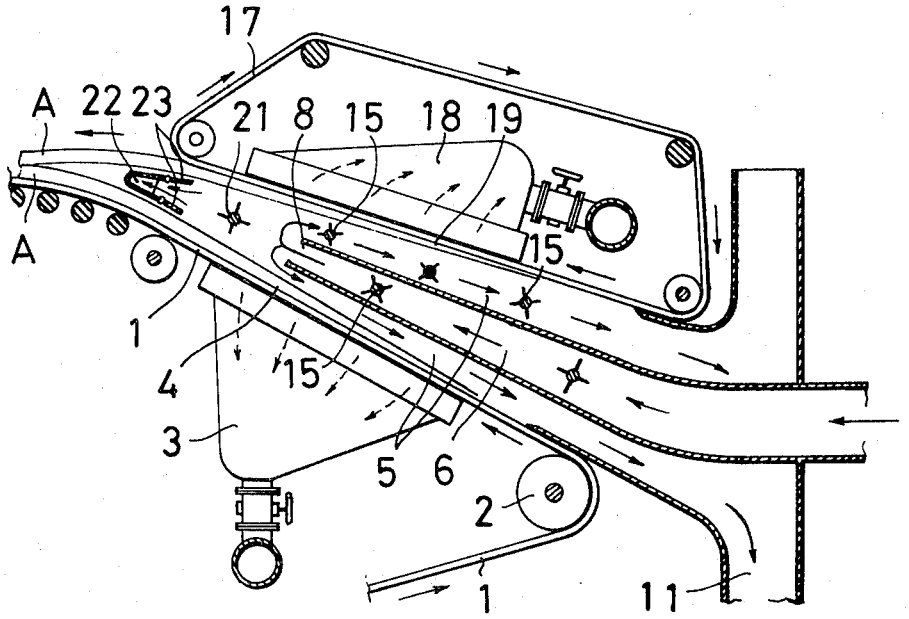
FIG. 2 is a sectional side view of an important section of a modified example thereof.

FIG. 2 shows a modified example of the invention for making a fiberboard of larger thickness. The slanted fiber layer forming section 4 in the foregoing example is prepared as a lower one, and there is provided above the same, through the flow passage 5, another fiber layer forming section 19 comprising a fiber layer conveyor 17 arranged to run endlessly and a suction box 18, and it is so contemplated that respective fiber layers may be made by the upper and lower fiber layer forming sections 4, 19 and be put one upon another integrally, for forming a sheet of fiberboard of very large thickness. Additionally, it is so provided that the slurry of raw material fibers supplied from the supply duct 6 are so inserted into the center of the flow passage 5 and that the front end supply opening 8 is positioned to open at the upper portion of the inclination of the flow passage 5, and consequently the raw material fibers flowing out from the supply opening 8 diverge upwardly and downward as to flow down along on the respective fiber layer forming sections 4, 19.

BEST MODE OF INVENTION

The apparatus for manufacturing the fiberboard is in the form of an endless conveyor 1 upon which a fiber layer of material is formed. The conveyor 1 has a slanted running portion as a part thereof. A suction box 3 is disposed along the inner surface of the slanted running portion so that a fiber layer producing section 4 is formed thereat. A passage 5 is formed along the other surface of conveyor 1 to direct a slurry flow of fiber material along the conveyor. The relative speeds of the slurry flow through passage along the surface of conveyor 1 is adjusted to be different than the running speed of the conveyor 1.

Figure 4:
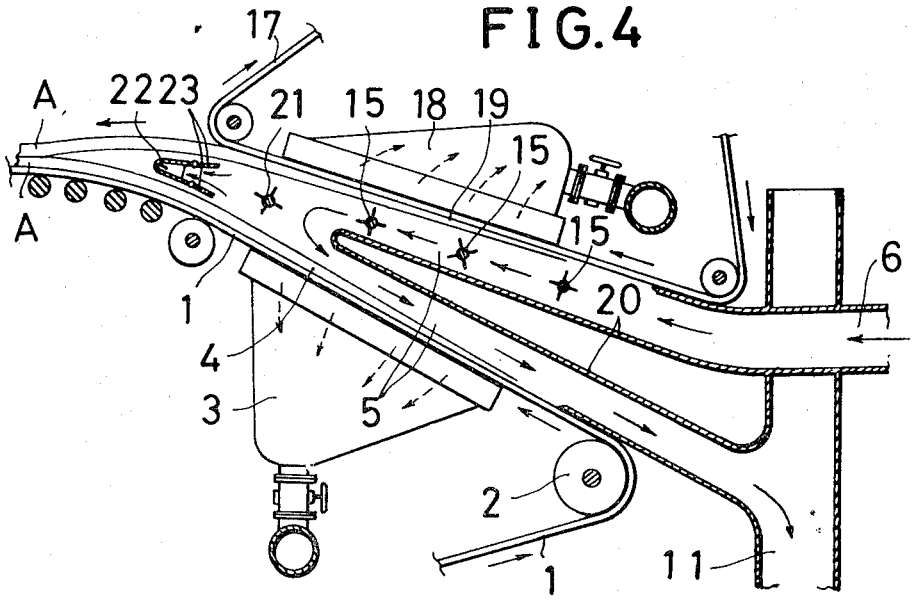
FIG. 4 is a sectional side view of an important section of another modified example thereof.

Alternatively, the arrangement for supplying the slurry raw material fibers can be so modified as shown in FIG. 4. Namely, a partition wall 20 for dividing into upper and lower portions is interposed in the flow passage 5, and the upper portion of the flow passage is connected to the supply duct 6 for use also as a raw material supply passage. Thus, the slurry of raw material fibers is supplied upwards into the upper portion flowing passage from the lower end thereof and thereafter are turned to flow down from the upper end thereof into the slanted lower portion flow passage, so that respective fiber layers may be made at the upper and lower fiber forming sections 4, 19. In this case, the flow speed of the raw material fiber slurry flowing into the upper portion of the flow passage from the lower end thereof is differentiated from the running speed of the fiber layer forming section 19.

Referring to FIGS. 2 and 4, numeral 21 denotes a ravelling means comprising a roller with fins and provided in front of the flow passage 5, and the same serves to prevent the flowing raw material fibers from entangling together into a lump and mixing in the layer. A suction chamber 22 is provided transversely along the width between the upper and lower fiber layers further in front of the flow passage 5, and a transversely extending suction opening 23 thereof is open against the fiber layer forming direction, and thus the same serves in such a manner that a part of the raw material fibers flowing forwardly is forced to flow into the same and thereafter flows out sideways, whereby the amounts of the raw material fibers flowing to the upper and lower fiber layer making sections 4, 19 are adjusted for adjusting the thickness of each layer. Additionally the raw material fiber distributed at random can be prevented as much as possible to be interposed between the upper and lower layers to minimize a lowering of the bending strength of the fiberboard by the interposition thereof.

Figure 5:
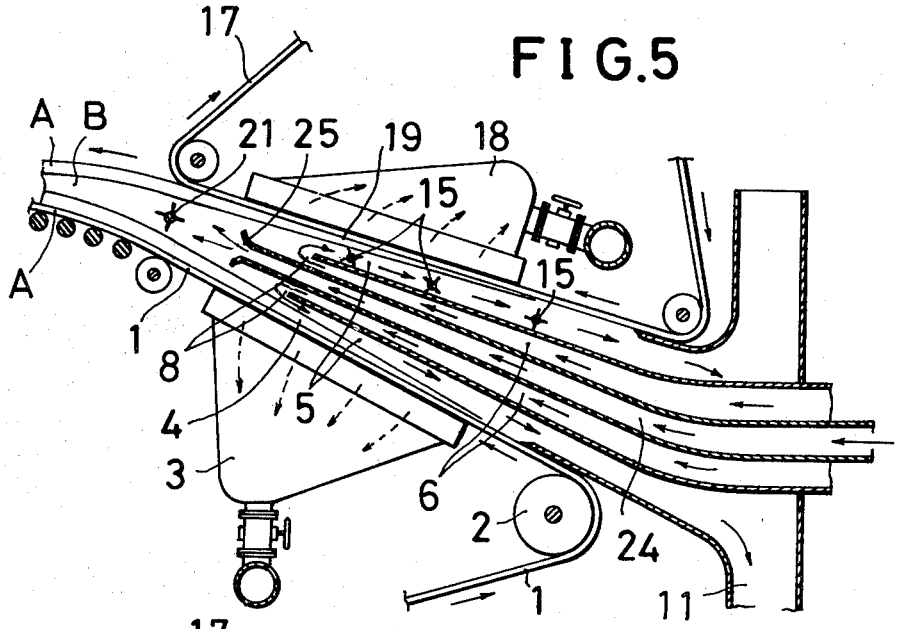
FIGS. 5 and 6 are sectional side views of important sections of other modified examples of the same.
Figure 6:
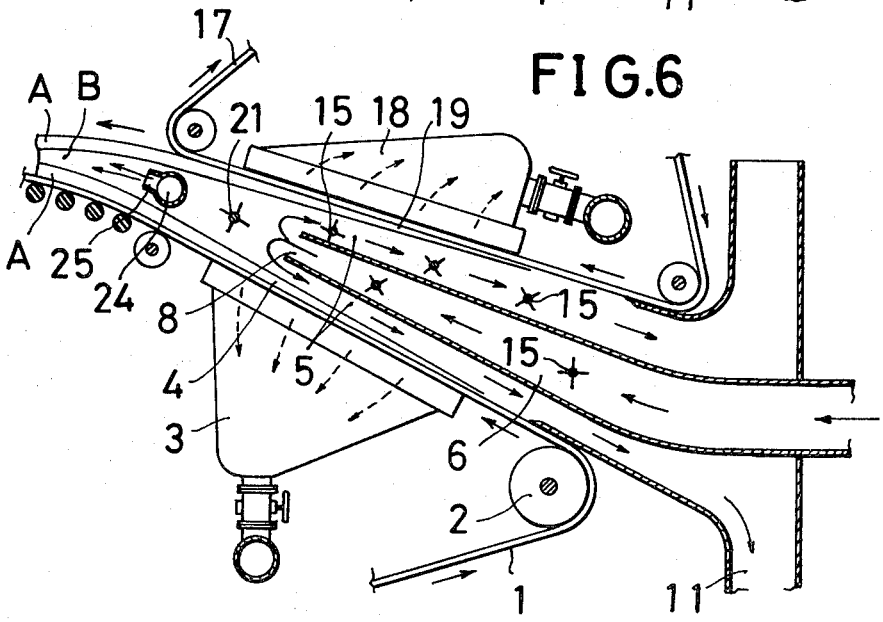

FIGS. 5 and 6 each show a modified example of this invention for making a fiberboard of much larger thickness. Namely, in each case, separately from the supply line for the raw material fiber slurry supply to the flow passage 5 for the upper and lower fiber layer forming sections 4, 19, another supply line for supplying additional slurry raw material fibers of the same or different kind is provided so that an intermediate layer may be made between the upper and lower fiber layers. In the embodiment shown in FIG. 5, as one supply line for supplying the raw material fibers for making the intermediate layer, a subsidiary supply duct 24 is inserted in the supply duct 6 to form a subsidiary supply passage therein, and a front end supply opening 25 thereof is positioned to open ahead of the supply opening 8 of the supply duct 6. In the embodiment shown in FIG. 6, the subsidiary supply duct 24 is provided transversely in the width between the upper and lower layers in front of the flow passage 5, and the supply opening 25 is so open as to direct in a forward direction. Thus, by supplying the raw material fiber slurry through the subsidiary supply duct 24, a predetermined thickness of the intermediate fiber layer is formed between the upper and lower fiber layers, and accordingly a sheet of fiberboard of an especially large thickness can be obtained. If any economical raw material only for the purpose of increasing the size is used for preparing for the intermediate layer, the fiberboard of a very large thickness can be obtained economically. For this purpose, for instance, fibers cheaper than the fibers used for the fiber layer making, and/or any fibers of inorganic or organic powders may be used. If the adhesive agent such as cement or the like is mixed in the slurry raw material fibers for the intermediate layer in an increased quantity, that intermediate layer serves as a medium for strengthening and binding between the upper and lower layers and additionally serves to increase the strength of the whole of the fiberboard.

Figure 7:
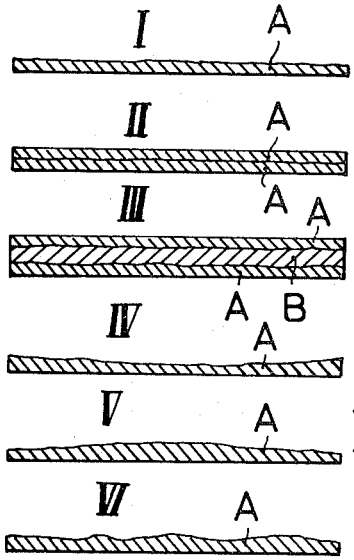
FIG. 7 is a cross sectional view of fiberboards.

FIG. 7 shows cross sectional views of the produced fiberboards. FIG. 7 I shows a single fiber layer A and produced by the fundamental construction of apparatus as shown in FIG. 1, FIG. 7 II shows one comprising the integral upper and lower layers A, A produced by the construction as shown in FIG. 2 or 4, and FIG. 7 III shows one comprising such integral three layers that an intermediate layer B is interposed between the upper and lower layers A, A.

As shown in these cross sectional views, it is ideal that the fiberboard is substantially equal in thickness at every portion without any unevenness. However, there is actually often caused products having a varied thickness of the fiber layer resulting from a partially unequal suction force occurring at the time of forming due to a clogging phenomenon or the like of the suction openings of the suction box or that of the permeability of the fiber layer making conveyor, and it happens for instance that the resultant layer becomes concave, convex or an irregular concave and convex one as shown in FIGS. 7 IV, V, VI.

For correcting such inequality of thickness as above, according to this invention, the suction force of the suction box may be adjusted at individual portions transverse to the direction of the fiber layer, so as to adjust the fiber layer thickness to become uniform.

Figure 8:
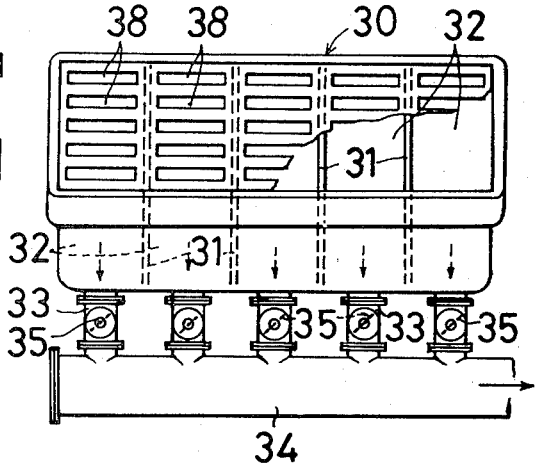
FIG. 8 is a front view, partly in section of part a suction box section having a suction force adjusting means.

As for one example, an adjusting means, as shown in FIG. 8 has the interior of the suction box 30 divided by partition walls 31 into plural suction chambers 32 disposed in the transverse direction of the fiber layer to be made, and the respective chambers 32 are in communication, in parallel one with another, with a suction tube 34 through respective connecting tubes 33, and each connecting tube 33 is provided therein with each adjusting valve 35, so that by selectively adjusting these valves 35, the distribution of the suction force at the front surface of the suction box 30 can be adjusted at individual parts in the width direction thereof.

Figure 9:
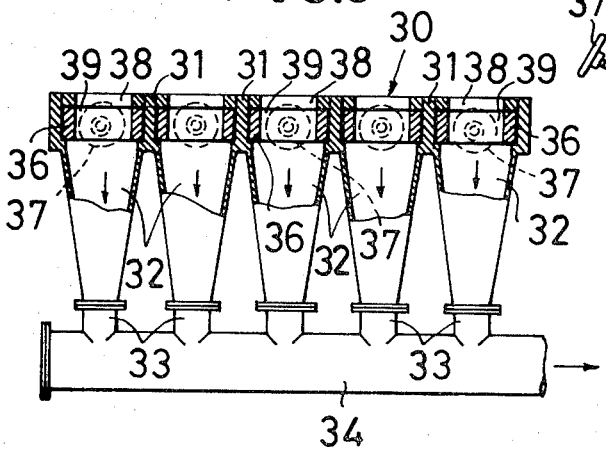
FIG. 9 is a sectional view of a modified example of the suction box section in FIG. 8.
Figure 10:
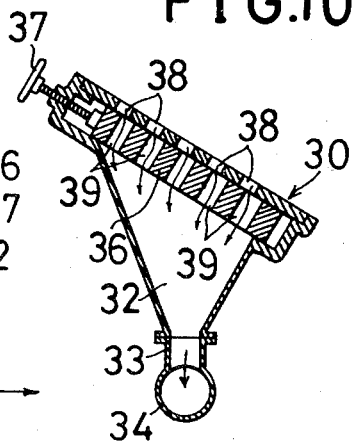
FIG. 10 is a longitudinally sectional side view of the same.

FIGS. 9 and 10 show another example of the suction force adjusting means. In such an arrangement, the interior of the suction box 30 is divided by the partition walls 31 into the plural suction chambers 32 disposed in the width direction thereof, and each suction chamber 32 is connected through the connecting tube 33 to the suction tube 34 as mentioned before. A perforation plate 36 is so provided in each suction chamber 32 so as to move slidably by an operation rod 37, so that it can be varied by a slide movement thereof, the opening area depending on the overlapping degree of suction openings 38 in the front surface of the suction chamber 32 and openings 39 of the perforation plate 36 is varied, and thereby each suction chamber 32 is adjusted as diversely in its suction force.

By using the suction box having the foregoing suction force adjusting mechanism, the thickness in the width direction of the layer can be corrected at will and there can be obtained a layer which is uniform in thickness at every portion.

Many modifications and variations of the present invention are possible in light of the above teachings. It is, therefore, to be understood that within the scope of the appended claims, the invention may be practiced otherwise than as particularly described.

What is claimed is:

1. An apparatus for manufacturing fiberboard, comprising:

a first endless belt conveyor having a slanted portion constituting a first fiber layer forming section;

a first suction box provided on the inner surface of said first fiber layer forming section;

a second endless belt conveyor having a slanted portion constituting a second fiber layer forming section disposed above said first fiber layer forming section;

a second suction box provided on the inner surface of said second fiber layer forming section;

a passage means disposed between said first and second fiber layer forming sections for directing a slurry flow of fibers and so arranged whereby the speed of the slurry flow through the passage and onto the surfaces of said first and second fiber layer forming sections is differentiated from the running speed of said conveyors;

a supply duct for the slurry of fibers, said duct being disposed in the center of said passage and having an outlet positioned near the upper ends of said first and second fiber layer forming sections whereby the slurry flow of fibers from said outlet diverges upwards and downwards and flows down the respective first and second fiber layer forming sections so that two separate fiber layers may be formed simultaneously and subsequently placed one upon another to form a single sheet of fiberboard.

2. The apparatus according to claim 1 further comprising partition walls dividing each of said two suction boxes into a plurality of suction chambers disposed in the width direction of said first and second fiber layer forming sections respectively, and means in each of said suction chambers for adjusting the suction force thereof.

* * * * *